US012768545B2

(12) United States Patent
Heinz

(10) Patent No.: US 12,768,545 B2
(45) Date of Patent: Oct. 20, 2026

(54) COOKING APPLIANCE INCLUDING A COOKING CHAMBER AND A FAN FOR CIRCULATING COOKING CHAMBER AIR, AND METHOD FOR OPERATING THE SAME

(71) Applicant: Miele & Cie. KG, Guetersloh (DE)

(72) Inventor: Volker Heinz, Obernkirchen (DE)

(73) Assignee: Miele & Cie. KG, Guetersloh (DE)

( * ) Notice: Subject to any disclaimer, the term of this patent is extended or adjusted under 35 U.S.C. 154(b) by 387 days.

(21) Appl. No.: 18/567,030

(22) PCT Filed: Jun. 3, 2022

(86) PCT No.: PCT/EP2022/065156
§ 371 (c)(1),
(2) Date: Dec. 5, 2023

(87) PCT Pub. No.: WO2022/268479
PCT Pub. Date: Dec. 29, 2022

(65) Prior Publication Data

US 2024/0263803 A1 Aug. 8, 2024

(30) Foreign Application Priority Data

Jun. 22, 2021 (BE) ..... 2021/5486

(51) Int. Cl.
*F24C 7/08* (2006.01)
*F24C 15/32* (2006.01)

(52) U.S. Cl.
CPC ..... *F24C 15/322* (2013.01); *F24C 7/087* (2013.01)

(58) Field of Classification Search
CPC ..... F24C 7/087; F24C 15/322
See application file for complete search history.

(56) References Cited

U.S. PATENT DOCUMENTS

| | | | | |
|---|---|---|---|---|
| 5,526,734 | A | 6/1996 | Harrison | |
| 2015/0159882 | A1* | 6/2015 | Heinz | F24C 15/006 99/344 |
| 2018/0292092 | A1* | 10/2018 | Bhogal | F24C 7/085 |

FOREIGN PATENT DOCUMENTS

| | | | |
|---|---|---|---|
| DE | 2460294 | A1 | 7/1976 |
| DE | 102015109854 | A1 | 12/2016 |
| DE | 102016115529 | A1 | 2/2018 |
| EP | 3838086 | A1 | 6/2021 |

(Continued)

*Primary Examiner* — Alfred Basichas
(74) *Attorney, Agent, or Firm* — Leydig, Voit & Mayer, Ltd.

(57) ABSTRACT

A cooking appliance includes: a housing; a cooking chamber disposed in the housing and bounded by cooking chamber walls of the housing; a cooking chamber door for closing a cooking chamber opening of the cooking chamber in a closed position of the cooking chamber door; at least one heater for heating the cooking chamber; a fan for circulating cooking chamber air present in the cooking chamber, a fan wheel of the fan being disposed in the cooking chamber, and a motor of the fan being mounted on the housing outside the cooking chamber, the fan wheel being torque-transmittingly connected to the motor via a drive shaft extending through a drive shaft opening in one of the cooking chamber walls; and a controller for controlling the heater and the fan. The fan wheel is automatically displaceable axially to the drive shaft between a first end position and a second end position.

20 Claims, 8 Drawing Sheets

(56) References Cited

FOREIGN PATENT DOCUMENTS

| | | | |
|---|---|---|---|
| FR | 2396244 | A1 | 1/1979 |
| JP | 2006283584 | A | 10/2006 |

* cited by examiner

COOKING APPLIANCE INCLUDING A COOKING CHAMBER AND A FAN FOR CIRCULATING COOKING CHAMBER AIR, AND METHOD FOR OPERATING THE SAME

CROSS-REFERENCE TO PRIOR APPLICATIONS

This application is a U.S. National Phase application under 35 U.S.C. § 371 of International Application No. PCT/EP2022/065156, filed on Jun. 3, 2022, and claims benefit to Belgian Patent Application No. BE 2021/5486, filed on Jun. 22, 2021. The International Application was published in German on Dec. 29, 2022 as WO/2022/268479 A1 under PCT Article 21(2).

FIELD

The invention relates to a cooking appliance including a cooking chamber and a fan for circulating cooking chamber air, and a method for operating the same.

BACKGROUND

Such cooking appliances and methods for operating the same have been previously described in various embodiments in the art and include a housing having a cooking chamber disposed in the housing and bounded by cooking chamber walls of the housing, a cooking chamber door for closing a cooking chamber opening of the cooking chamber in a closed position of the cooking chamber door, at least one heater for heating the cooking chamber, a fan for circulating cooking chamber air present in the cooking chamber, a fan wheel of the fan being disposed in the cooking chamber, and a motor of the fan being mounted on the housing outside of the cooking chamber, and the fan wheel being torque-transmittingly connected to the motor via a drive shaft extending through a drive shaft opening in one of the cooking chamber walls, and a controller for controlling the heater and the fan.

SUMMARY

In an embodiment, the present invention provides a cooking appliance, comprising: a housing: a cooking chamber disposed in the housing and bounded by cooking chamber walls of the housing: a cooking chamber door configured to close a cooking chamber opening of the cooking chamber in a closed position of the cooking chamber door: at least one heater configured to heat the cooking chamber: a fan configured to circulate cooking chamber air present in the cooking chamber, a fan wheel of the fan being disposed in the cooking chamber, and a motor of the fan being mounted on the housing outside the cooking chamber, the fan wheel being torque-transmittingly connected to the motor via a drive shaft extending through a drive shaft opening in one of the cooking chamber walls; and a controller configured to control the heater and the fan, wherein the fan wheel is automatically displaceable axially to the drive shaft between a first end position and a second end position of the fan wheel and positionable in the respective end positions by a displacement device of the cooking appliance connected in signal communication with the controller, the displacement and positioning being performed as a function of an operating state of the cooking appliance and/or a cooking program selected on the cooking appliance and/or a cooking process in the cooking chamber.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
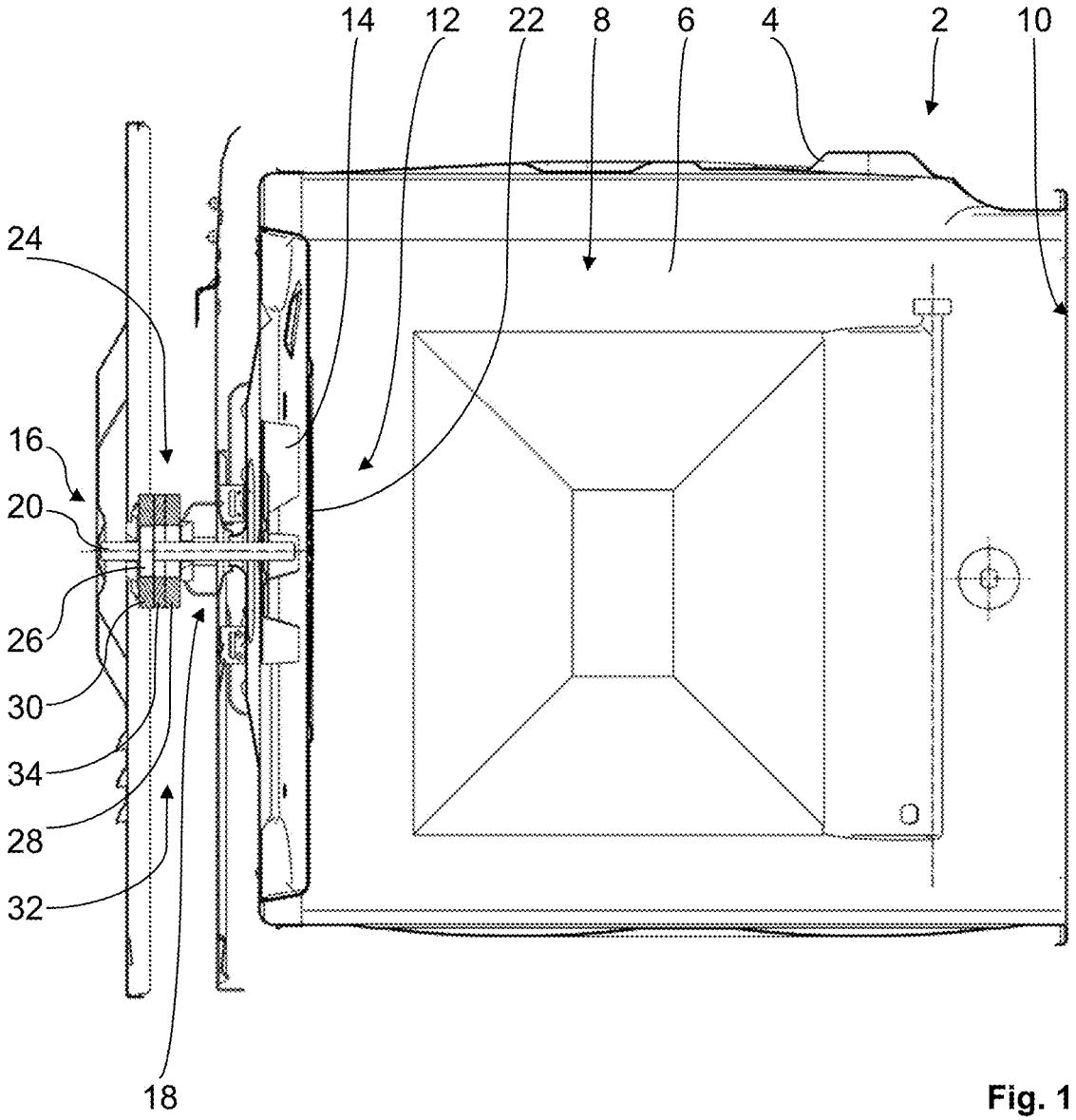
FIG. 1 is a partially cross-sectional side view of a first exemplary embodiment of the inventive cooking appliance for performing the method of the invention.
Figure 2:
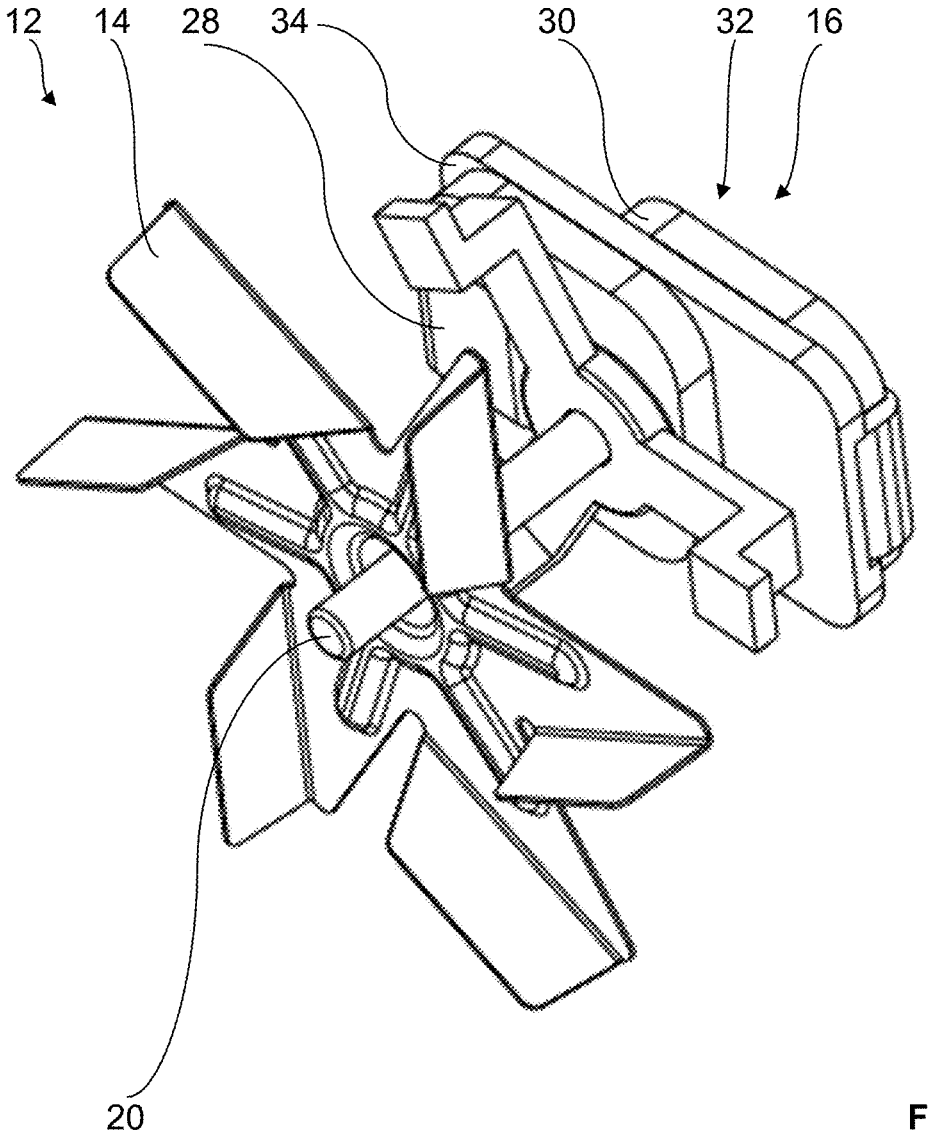
FIG. 2 is an enlarged isolated perspective view of the fan of the first exemplary embodiment.
Figure 3A:
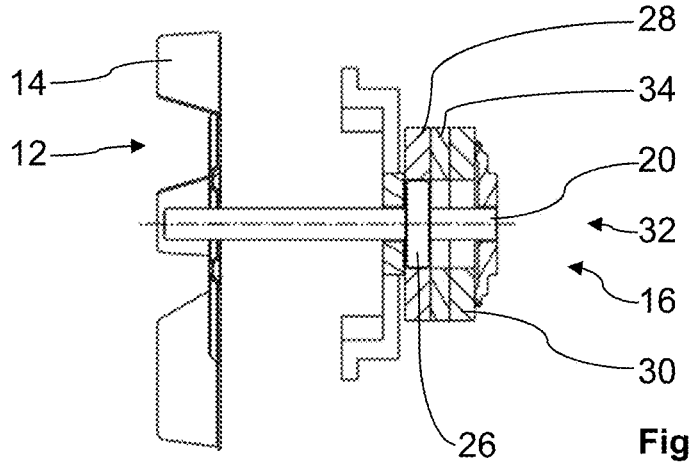
FIG. 3*a* is a first cross-sectional side view of the fan of FIG. 2, showing the fan wheel in its first end position.
Figure 3B:
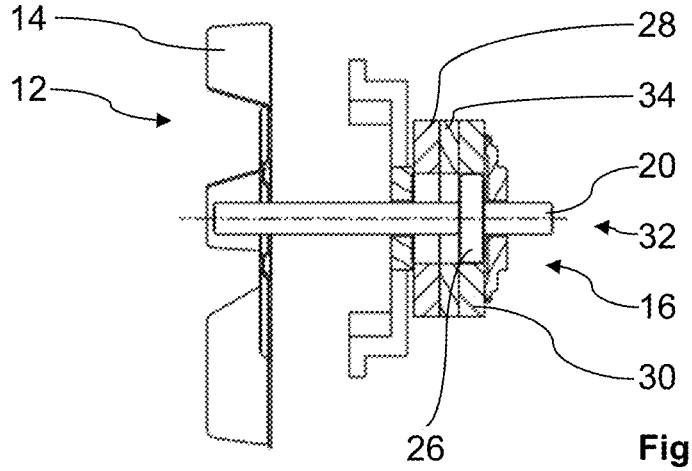
FIG. 3*b* is a second cross-sectional side view of the fan of FIG. 2, showing the fan wheel in its second end position.
Figure 3C:
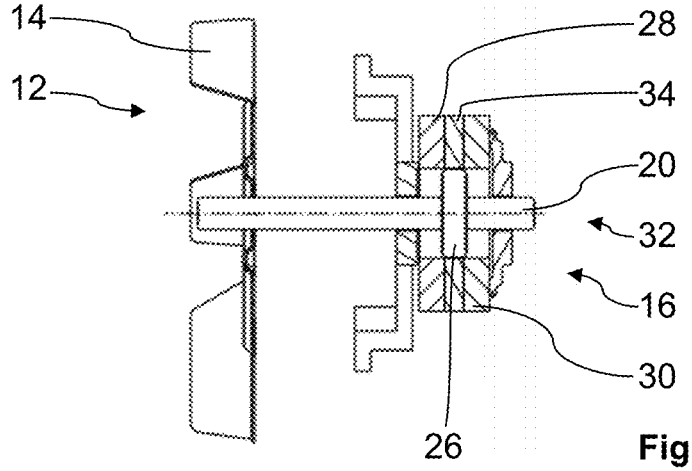
FIG. 3*c* is a third cross-sectional side view of the fan of FIG. 2, showing the fan wheel in its intermediate position.
Figure 4:
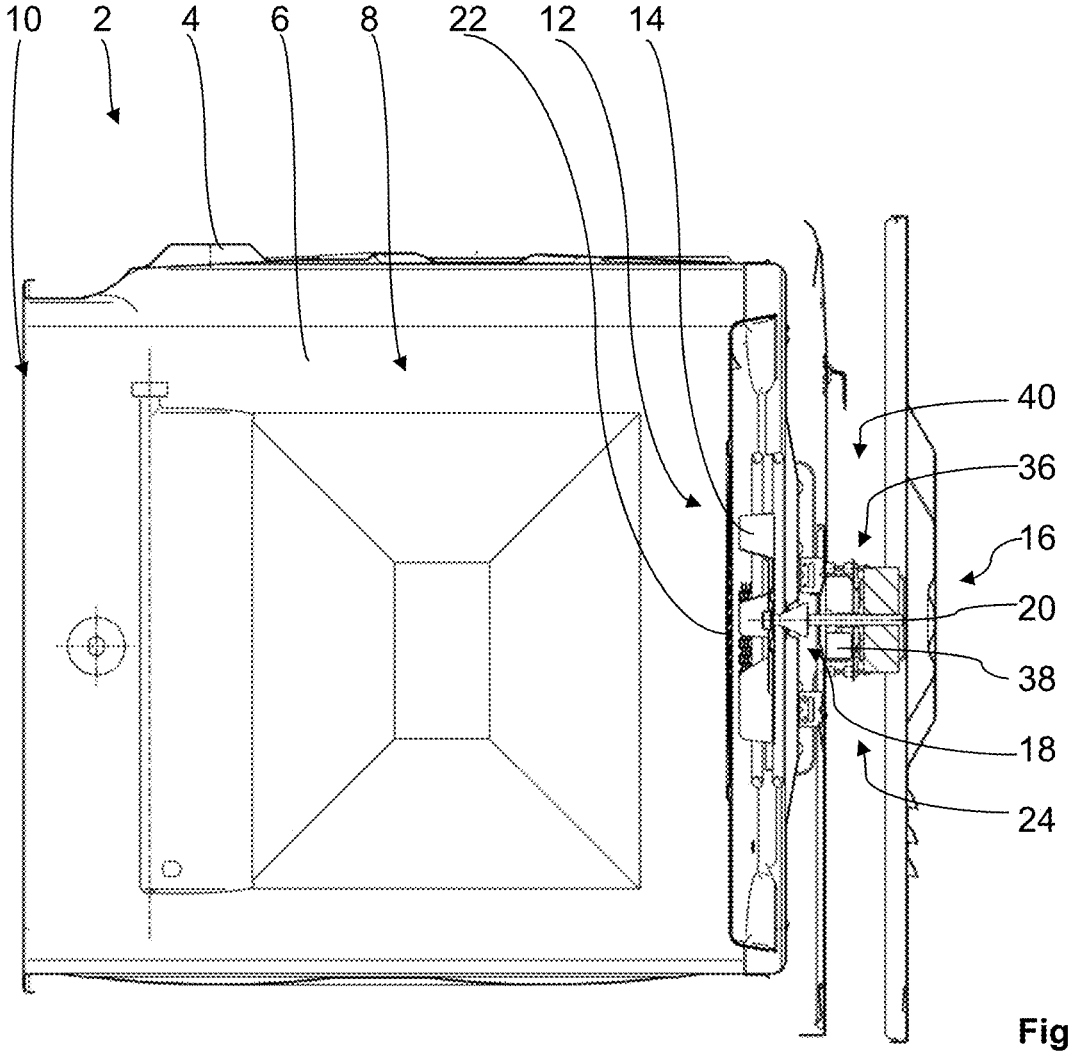
FIG. 4 is a partially cross-sectional side view of a second exemplary embodiment of the inventive cooking appliance for performing the method of the invention.

In an embodiment, the present invention improves a cooking appliance including a cooking chamber and a fan for circulating cooking chamber air, and a method for operating the same.

In an embodiment, the present invention provides a cooking appliance which has the features described herein and which is characterized in that the fan wheel is automatically displaceable axially to the drive shaft between a first end position and a second end position of the fan wheel and positionable in the respective end positions by means of a displacement device of the cooking appliance connected in signal communication with the controller, such displacement and positioning being performed as a function of an operating state of the cooking appliance and/or a cooking program selected on the cooking appliance and/or a cooking process in the cooking chamber. The cooking appliance according to the invention may be, for example, a baking oven, a microwave appliance, a steam cooker, or a combination appliance having a plurality of different types of heating. Moreover, the cooking appliance according to the invention may be a household appliance or an industrial appliance; i.e., a cooking appliance for professional use.

The advantage provided by the invention is, in particular, that a cooking appliance including a cooking chamber and a fan for circulating cooking chamber air, and a method for operating the same are improved. Due to the inventive design of the cooking appliance and method, namely due to the variable positioning of the fan wheel of the fan in the cooking chamber axially to the drive shaft, a flow through the oven chamber is adjustable, thereby allowing a cooking process being performed in the cooking chamber of the inventive cooking appliance to be influenced in the desired manner. Accordingly, the heat distribution in the cooking chamber and, thus, the cooking result of a cooking process being performed in the cooking chamber of the inventive cooking appliance can be influenced much better in the desired manner. Thus, the cooking process is controllable in the desired manner not only via a rotational speed of the fan for circulating the cooking chamber air, but also by the position of the fan wheel in the cooking chamber axial to the drive shaft, for example, behind a rear wall placed in the cooking chamber.

The cooking appliance according to the invention can, in principle, be freely selected within wide suitable limits in terms of type, function, material, and dimensions. In this regard, see also the explanations above in the introductory part of the specification.

A particularly advantageous embodiment of the inventive cooking appliance provides that the displacement device is configured such that the fan wheel is automatically positionable by the displacement device in at least one intermediate position of the fan wheel between the first end position and the second end position as a function of an operating state of the cooking appliance and/or a cooking program selected on the cooking appliance and/or a cooking process in the cooking chamber. In this way, the adjustability of the position of the fan wheel axial to the drive shaft is further improved, so that the circulation of the cooking chamber air can be made even more variable.

Accordingly, an advantageous embodiment of the inventive method provides that the displacement device automatically positions the fan wheel in at least one intermediate position of the fan wheel between the first end position and the second end position as a function of an operating state of the cooking appliance and/or a cooking program selected on the cooking appliance and/or a cooking process in the cooking chamber.

Another advantageous embodiment of the inventive cooking appliance provides that the cooking appliance has at least one sensor connected in signal communication with the controller and used for automatically sensing at least one cooking parameter of the cooking process, preferably, that the at least one sensor takes the form of a cooking chamber camera for observing a food item present in the cooking chamber and/or a humidity sensor for determining a cooking chamber humidity prevailing in the cooking chamber and/or a temperature sensor for determining a cooking chamber temperature in the cooking chamber and/or a food item temperature of a food item present in the cooking chamber. In this way, the positioning of the fan wheel axially to the drive shaft as a function of a cooking process being performed in the cooking chamber of the inventive cooking appliance can be implemented in a particularly effective manner. With the aid of the at least one sensor for automatically sensing at least one cooking parameter of the cooking process, the position of the fan wheel of the fan can be adjusted axially to the drive shaft in a suitable manner according to the requirements of the particular case. This applies especially to the preferred variant of this embodiment. The cooking chamber camera may be designed for visible light and/or for infrared radiation.

Accordingly, an advantageous embodiment of the inventive method provides that the cooking appliance has at least one sensor connected in signal communication with the controller and used for automatically sensing at least one cooking parameter of the cooking process, preferably, that the at least one sensor is used to observe, in a camera-based manner, a food item present in the cooking chamber and/or to determine a cooking chamber humidity prevailing in the cooking chamber and/or to determine a cooking chamber temperature in the cooking chamber and/or a food item temperature of a food item present in the cooking chamber.

Another advantageous embodiment of the inventive cooking appliance provides that the displacement device includes the motor, the motor being designed as a shaded-pole motor in such a way that the drive shaft torque-transmittingly connected to a rotor of the shaded-pole motor automatically moves the fan wheel to, and positions it in, its first end position or in its second end position, preferably to/in its first end position, to/in its at least one intermediate position, or to/in its second end position by means of the rotor supported in a stator of the shaded-pole motor, such movement and positioning being performed as a function of the manner in which a plurality of coils of the stator are controlled. In this way, the displacement device can be implemented in a particularly simple manner in terms of construction, production, and circuitry, and in very space-saving way.

An advantageous refinement of the aforementioned embodiment of the inventive cooking appliance provides that the plurality of coils are in the form of a first coil and a second coil separated from the first coil by an electric insulator, the first coil and the second coil as well as the controller being configured such that the first coil and the second coil can be electrically conductively interconnected in a series electrical circuit and/or in a parallel electrical circuit by means of the controller. In this way, the positioning of the fan wheel axially to the drive shaft is implemented in a particularly simple manner in terms of circuitry. This applies especially to the design of the displacement device by means of which the fan wheel can be automatically positioned in at least one intermediate position of the fan wheel between the first end position and the second end position, in addition to its first end position and its second end position.

Another particularly advantageous embodiment of the inventive cooking appliance provides that a cone is formed and disposed on the drive shaft and a conical boundary surface of the drive shaft opening, which boundary surface corresponds in configuration to the cone, is formed and disposed on the cooking chamber wall bounding the drive shaft opening and in such a way that the cone and the boundary surface form an annular gap for supplying fresh air from an ambient environment into the cooking chamber, a free cross section of the annular gap having a pre-defined minimum passage area in the first end position of the fan wheel and a pre-defined maximum passage area in the second end position of the fan wheel. In this way, the supply air quantity: i.e., the amount of fresh air drawn in from the ambient environment by the fan through the annular gap, is adjustable and, thus, the heat distribution in the cooking chamber is, in addition, controllable substantially independently of the rotational speed of the fan as a function of an operating state of the cooking appliance and/or a cooking program selected on the cooking appliance and/or a cooking process in the cooking chamber. In this connection, the positioning of the fan wheel axially to the drive shaft in the aforementioned range between the first end position and the second end position of the fan wheel may be effected continuously or in steps. Accordingly, this provides another way of influencing a cooking process and, thus, the cooking result of a cooking process being performed in the cooking chamber of the inventive cooking appliance. In combination with different rotational speeds of the fan for circulating the cooking chamber air and/or with a controlled removal of cooking vapors from the cooking chamber, additional possibilities arise for varying a flow through the oven chamber of the inventive cooking appliance while a cooking process is in progress.

An advantageous refinement of the aforementioned embodiment of the cooking appliance according to the invention provides that when the fan wheel is in the at least one intermediate position, the free cross section of the annular gap has a passage area whose size is between the minimum and the maximum passage area. Thus, when the fan wheel is in the at least one intermediate position, the area of the free cross section of the annular gap is larger than the passage area of the free cross section of the annular gap that corresponds to the first end position of the fan wheel and smaller than the passage area of the free cross section of the annular gap that corresponds to the second end position of the fan wheel. This allows fresh air to be supplied in a finely stepped manner from the ambient environment via the annular gap. As already explained above, the displacement of the fan wheel axial to the drive shaft by means of the displacement device may be effected continuously or in steps.

An advantageous refinement of the latter two embodiments of the cooking appliance according to the invention provides that the displacement device includes a motor mount for the motor, which motor mount is movably supported on the housing, and a motor mount drive force-transmittingly connected to the motor mount, the motor mount being displaceable axially to the drive shaft as a function of the manner in which the motor mount drive is controlled by the controller. In this way, the displacement device can be implemented in a particularly simple manner in terms of construction and production.

An advantageous refinement of the inventive cooking appliance provides that the motor mount includes a holding plate movably supported on the housing by means of a linear guide device of the cooking appliance for the motor mount, preferably, that the linear guide device includes a plurality of guide pins and corresponding guide openings, particularly preferably, that the guide pins are disposed on the housing and the guide openings are disposed or formed on the holding plate. In this way, the motor mount of the displacement device can be implemented in a robust manner in terms of production. This applies particularly to the preferred embodiment and especially to the particularly preferred embodiment of this refinement.

An advantageous refinement of the inventive cooking appliance provides that the motor mount drive controllable by the controller has a spur gear, and the holding plate has a gear rack which corresponds in configuration to the spur gear and is in engagement therewith. In this way, the force-transmitting connection between the motor mount drive on one side and the motor mount on the other side is implemented in a very robust and functionally reliable manner.

In FIGS. 1 through 3*c*, a first exemplary embodiment of the inventive cooking appliance is shown in purely schematic form.

Cooking appliance 2 is in the form of a baking oven for household use and includes a housing 4, a cooking chamber 8 disposed in housing 4 and bounded by cooking chamber walls 6 of housing 4, a cooking chamber door for closing a cooking chamber opening 10 of cooking chamber 8 in a closed position of the cooking chamber door, at least one heater for heating cooking chamber 8, a fan 12 for circulating cooking chamber air present in cooking chamber 8, a fan wheel 14 of fan 12 being disposed in cooking chamber 8, and a motor 16 of fan 12 being mounted on housing 4 outside of cooking chamber 8, and the fan wheel 14 being torque-transmittingly connected to motor 16 via a drive shaft 20 extending through a drive shaft opening 18 in one of the cooking chamber walls 6, and a controller for controlling the heater and fan 12. In the present exemplary embodiment, fan wheel 14 of fan 12 is disposed behind a rear wall 22 placed in cooking chamber 8 and having passage openings for the circulated cooking chamber air. The air circulated in cooking chamber 8 is also not shown in FIGS. 1 through 3*c*. As is customary in the art, cooking vapors and, thus, a portion of the cooking chamber air can here also be discharged from cooking chamber 8 into the ambient environment in a manner known to those skilled in the art while a cooking process is being performed in the cooking chamber.

In accordance with the invention, fan wheel 14 is automatically displaceable axially to drive shaft 20 between a first end position (shown in FIG. 3*a*) and a second end position (shown in FIGS. 1 and 3*a*) of fan wheel 14 and positionable in the respective end positions by means of a displacement device 24 of cooking appliance 2 connected in signal communication with the controller, such displacement and positioning being performed as a function of an operating state of cooking appliance 2 and/or a cooking program selected on cooking appliance 2 and/or a cooking process in cooking chamber 8. Furthermore, displacement device 24 is here configured such that fan wheel 14 is automatically positionable by displacement device 24 in an intermediate position of fan wheel 14 (shown in FIG. 3*c*) between the first end position and the second end position as a function of an operating state of cooking appliance 2 and/or a cooking program selected on cooking appliance 2 and/or a cooking process in cooking chamber 8. For purposes of displacing fan wheel 14 by means of the displacement device 24 as a function of a cooking process being performed in cooking chamber 8, cooking appliance 2 may have at least one sensor connected in signal communication with the controller and used for automatically sensing at least one cooking parameter of the cooking process. The at least one sensor is not shown in FIGS. 1 through 3*c*. Preferably, the at least one sensor takes the form of a cooking chamber camera for observing a food item present in cooking chamber 8 and/or a humidity sensor for determining a cooking chamber humidity prevailing in cooking chamber 8 and/or a temperature sensor for determining a cooking chamber temperature in cooking chamber 8 and/or a food item temperature of a food item present in cooking chamber 8.

In the present first exemplary embodiment, displacement device 24 includes motor 16, the motor 16 being designed as a shaded-pole motor in such a way that the drive shaft 20 torque-transmittingly connected to a rotor 26 of shaded-pole motor 16 automatically moves fan wheel 14 to, and positions it in, its first end position, to/in its at least one intermediate position, or to/in its second end position by means of the rotor 26 supported in a stator 32 of shaded-pole motor 16, such movement and positioning being performed as a function of the manner in which a plurality of coils 28, 30 of stator 32 are controlled. In the present exemplary embodiment, the plurality of coils 28, 30 are in the form of a first coil 28 and a second coil 30 separated from first coil 28 by an electric insulator 34, the first coil 28 and the second coil 30 as well as the controller being configured such that first coil 28 and second coil 30 can be electrically conductively interconnected by the controller in a series electrical circuit and/or in a parallel electrical circuit. In this regard, see FIGS. 3*a* through 3*c* together. Coils 28, 30 may, for example, be in the form of so-called "coil packs." It is also conceivable that coils 28, 30 may be configured differently so that different rotational speeds can be achieved for motor 16 with coils 28, 30. Accordingly, rotor 26 of motor 16 would rotate at a first speed when fan wheel 14 is in the first end position shown in FIG. 3*a* and at a second speed different from the first speed when fan wheel 14 is in the second end position shown in FIG. 3*b*. Moreover, two additional speeds of the rotor 26 of motor 16 and, thus, of the drive shaft 20 torque-transmittingly connected to rotor 26 can be implemented by means of the aforementioned series and parallel connections of the two coils 28, 30, with fan wheel 14 being in the intermediate position shown in FIG. 3*c*.

In the following, the operation of the inventive cooking appliance and the inventive method according to the first exemplary embodiment will be described in more detail with reference to FIGS. 1 through 3*c*.

The food item has been placed into cooking chamber 8 of cooking appliance 2, and the cooking chamber door has been closed. A user selects a cooking program for preparing the food item on cooking appliance 2 in a manner known to those skilled in the art and starts this cooking program and, thus, the cooking process. While the cooking process is being performed in cooking chamber 8, fan wheel 14 is automatically displaced axially to drive shaft 20 between the first end position, the intermediate position, and the second end position of fan wheel 14 and positioned in the first end position, the intermediate position, or the second end position by means of displacement device 24 as a function of the cooking program selected on cooking appliance 2 and of the cooking process being performed in cooking chamber 8, namely as a function of the at least one cooking parameter determined by the at least one sensor. To this end, motor 16, namely stator 32 of motor 16, is correspondingly controlled by the controller of cooking appliance 2 while the cooking process is being performed in cooking chamber 8. For example, when coil 28 is energized, rotor 26 is pulled axially to drive shaft 20 to the position shown in FIG. 3*a*, which corresponds to the first end position of fan wheel 14. When, in contrast, motor 16 is controlled by the controller in such a way that coil 30 is energized, then rotor 26 is pulled axially to drive shaft 20 to the position shown in FIG. 3*b*, which corresponds to the second end position of fan wheel 14. When both coils 28, 30 are energized: i.e., controlled, rotor 26 assumes the position shown in FIG. 3*c*, which corresponds to the intermediate position of fan wheel 14. Depending on whether the two coils 28, 30 are connected in series or in parallel, different rotational speeds are obtained for drive shaft 20 and, thus, for fan wheel 14.

In FIGS. 4 through 6*c*, a second exemplary embodiment of the inventive cooking appliance for performing the method of the invention is illustrated in purely schematic form. The second exemplary embodiment will be described below only to the extent that it differs from the first exemplary embodiment. Otherwise, reference is made to the above explanations regarding the first embodiment. Like or functionally equivalent components are given the same reference numerals.

In contrast to the first exemplary embodiment, the rotor (not explicitly shown in FIGS. 4 through 6*c*) and, thus, drive shaft 20 is not movable axially to drive shaft 20, as compared to the remainder of motor 16. Instead, in the present second exemplary embodiment, the entire motor 16 is moved axially to drive shaft 20, which will be explained in more detail below. For this purpose, in the second exemplary embodiment, displacement device 24 includes a motor mount 36 for motor 16, which motor mount 36 is movably supported on housing 4, and a motor mount drive 38 force-transmittingly connected to motor mount 36, the motor mount 36 being displaceable axially to drive shaft 20 as a function of the manner in which motor mount drive 38 is controlled by the controller. Similarly to the first exemplary embodiment, the controller is also not shown here.

Figure 5:
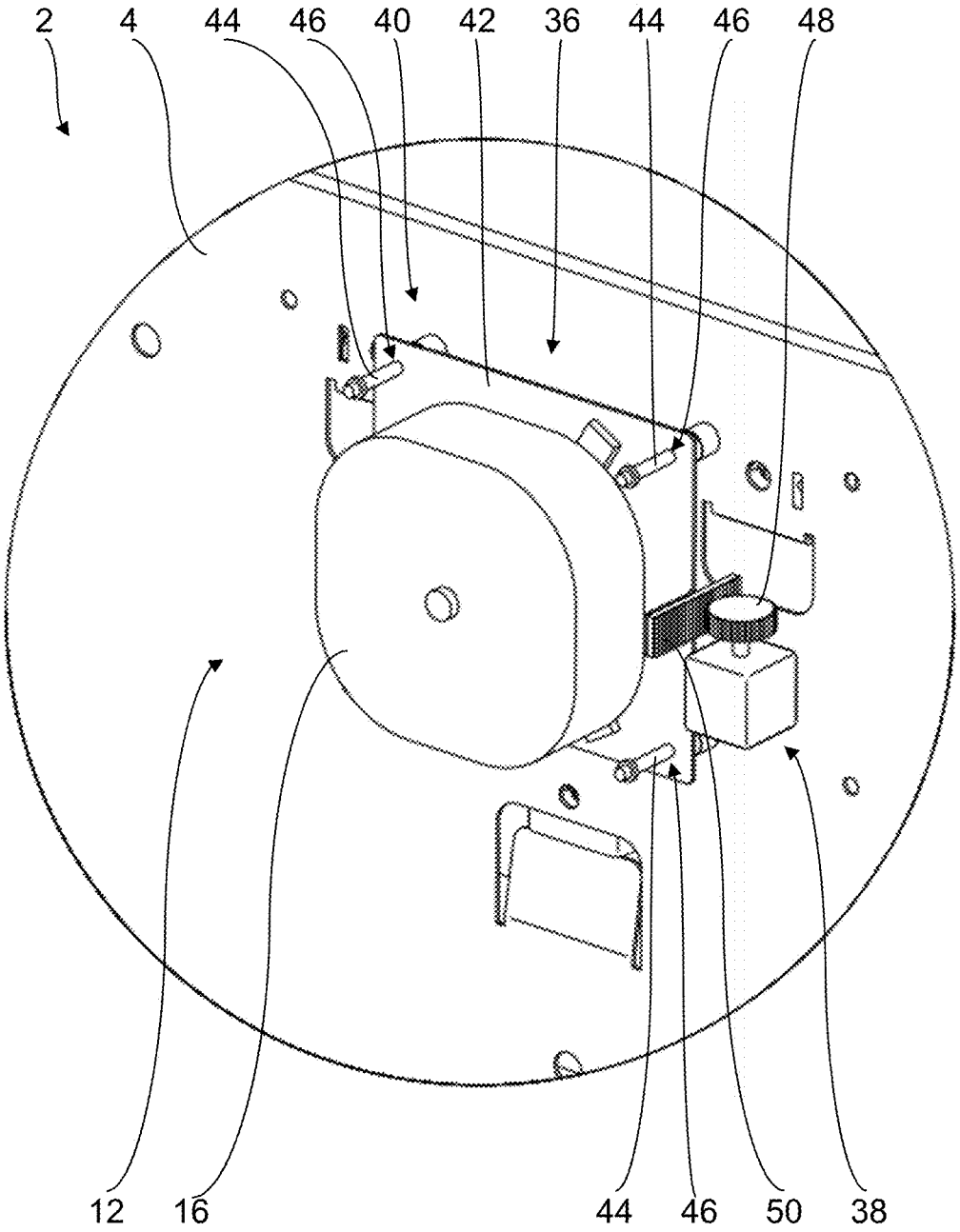
FIG. 5 is a rear perspective detail view of the second exemplary embodiment, showing the area of the motor of the fan.

Here, motor mount 36 includes a holding plate 42 movably supported on housing 4 by means of a linear guide device 40 of cooking appliance 2 for motor mount 36, the linear guide device 40 including four guide pins 44 and corresponding guide openings 46, namely such that guide pins 44 are disposed on housing 4 and guide openings 46 are formed on holding plate 42. In FIG. 5, only three of the guide pins 44 and three of the guide openings 46 are visible. The motor mount drive 38 controllable by the controller has a spur gear 48, and holding plate 42 has a gear rack 50 which corresponds in configuration to spur gear 48 and is in engagement therewith. In this regard, see FIG. 5.

Furthermore, the second exemplary embodiment is configured such that the supply of fresh air from the ambient environment is adjustable substantially independently of the rotational speed of fan 12.

Figure 6A:
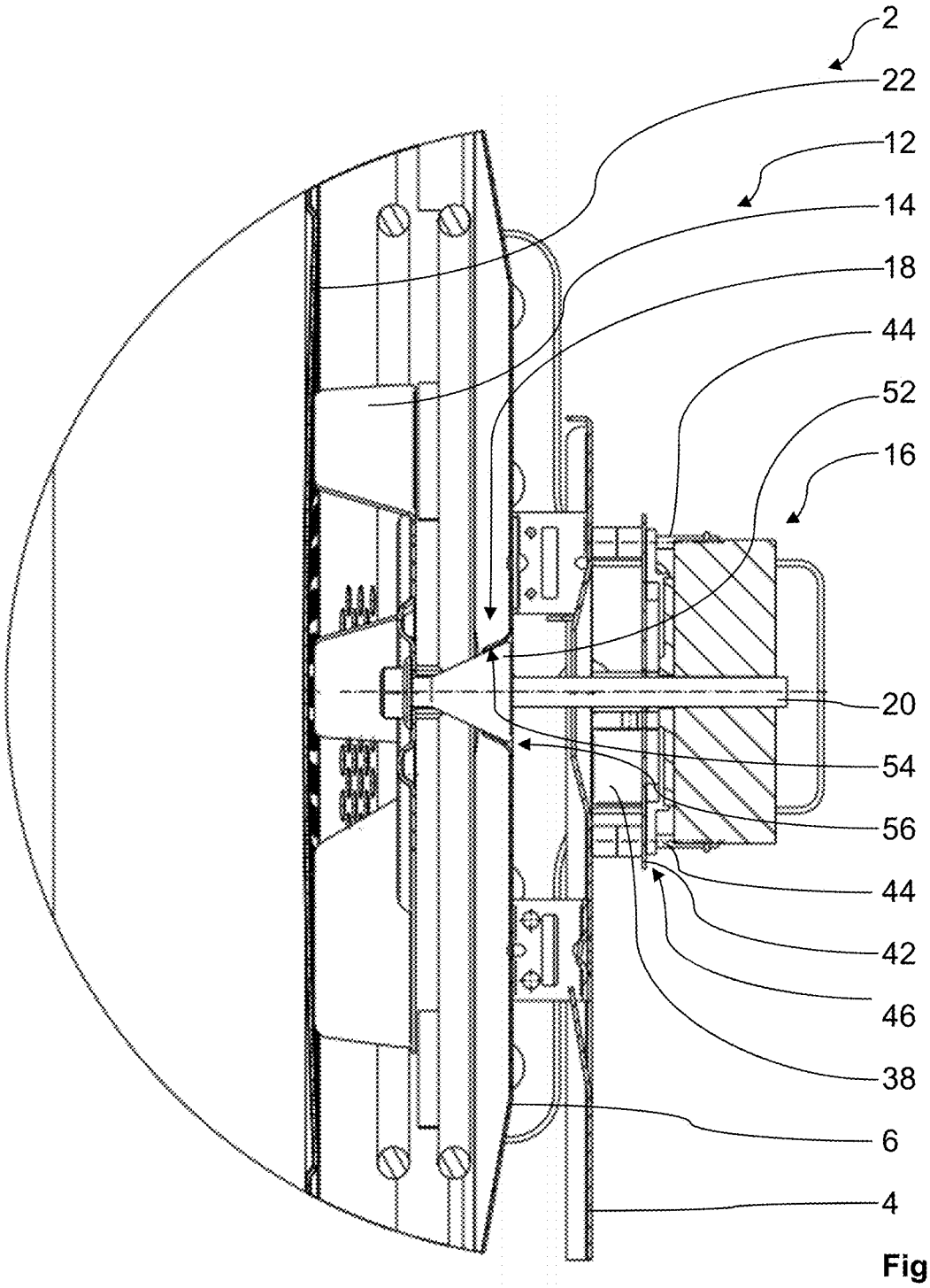
FIG. 6*a* is a first partially cross-sectional side view of the second exemplary embodiment, showing the area of the fan with the fan wheel in its first end position.
Figure 6B:
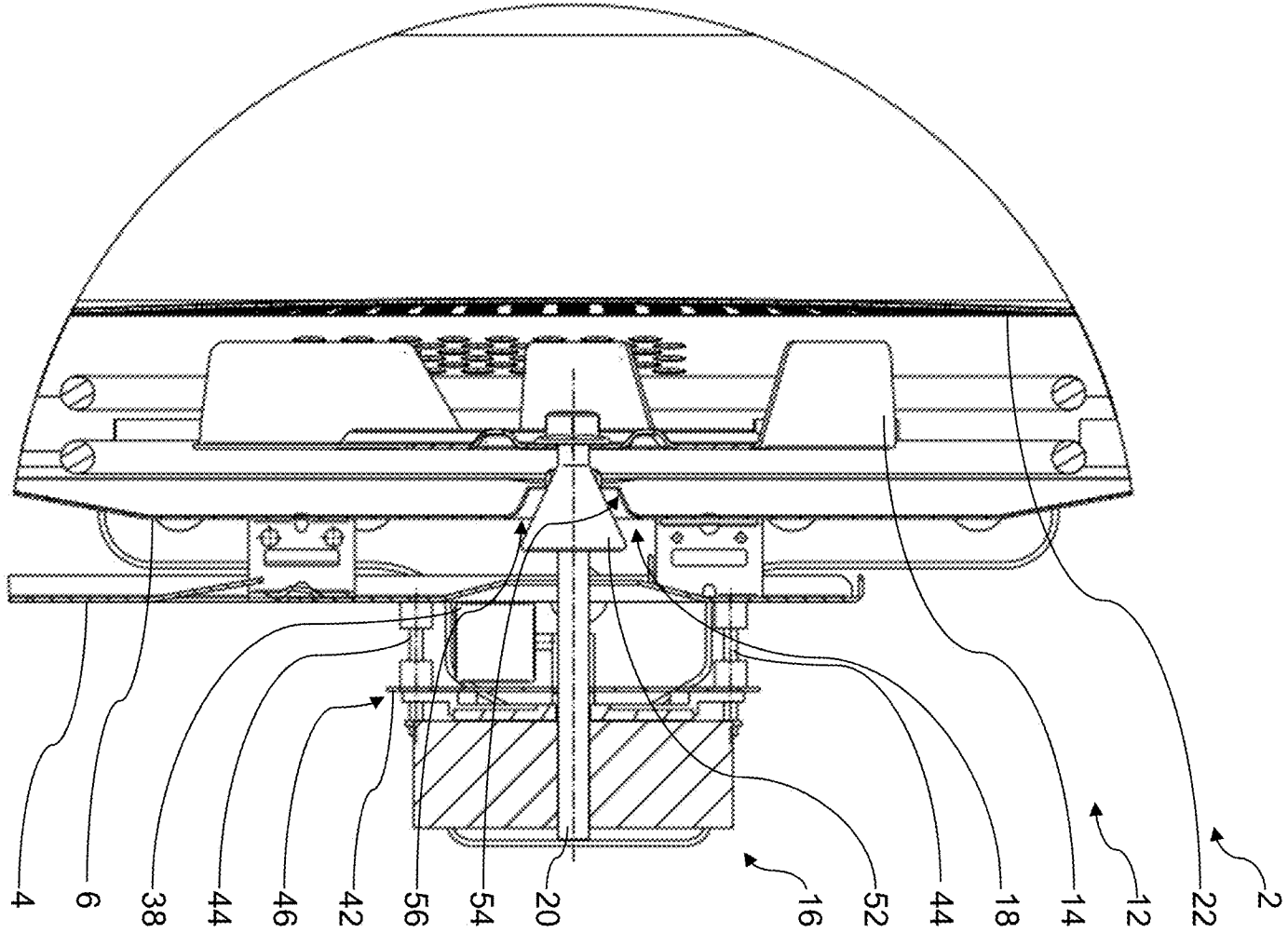
FIG. 6*b* is a second partially cross-sectional side view of the second exemplary embodiment, showing the area of the fan with the fan wheel in its intermediate position.
Figure 6C:
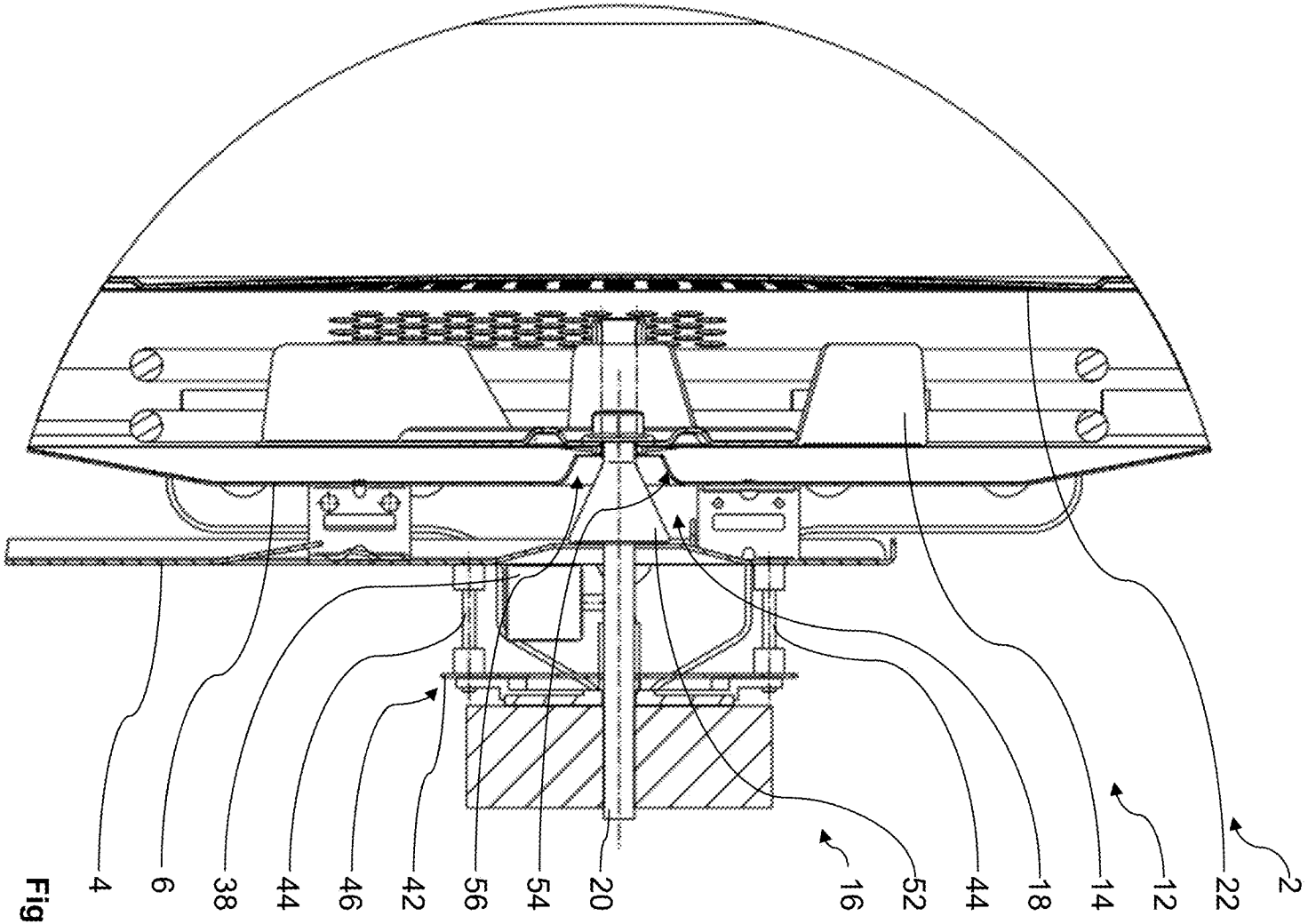
FIG. 6*c* is a third partially cross-sectional side view of the second exemplary embodiment, showing the area of the fan with the fan wheel in its second end position.

For this purpose, a cone 52 is formed and disposed on drive shaft 20 and a conical boundary surface 54 of drive shaft opening 18, which boundary surface 54 corresponds in configuration to cone 52, is formed and disposed on the cooking chamber wall 6 bounding the drive shaft opening 18 and in such a way that cone 52 and boundary surface 54 form an annular gap 56 for supplying fresh air from an ambient environment into cooking chamber 8, a free cross section of annular gap 56 having a pre-defined minimum passage area in the first end position of fan wheel 14, shown in FIG. 6*a*, and a pre-defined maximum passage area in the second end position of fan wheel 24, shown in FIG. 6*c*. Moreover, the present exemplary embodiment provides that a free cross section of annular gap 56 in the intermediate position of fan wheel 14 has a passage area whose size is between the minimum and the maximum passage area of annular gap 56. In this regard, see FIGS. 6*a* through 6*c* together.

In the following, the operation of the second exemplary embodiment of the inventive cooking appliance and the inventive method according to the second exemplary embodiment will be described in more detail with reference to FIGS. 4 through 6*c* to the extent that they differ from the first exemplary embodiment. Otherwise, reference is made to the first exemplary embodiment again.

The food item has been placed into cooking chamber 8 of cooking appliance 2, and the cooking chamber door has been closed. The user selects a cooking program for preparing the food item on cooking appliance 2 in a manner known to those skilled in the art and starts this cooking program and, thus, the cooking process. While the cooking process is being performed in cooking chamber 8, fan wheel 14 is automatically displaced axially to drive shaft 20 between the first end position, the intermediate position, and the second end position of fan wheel 14 and positioned in the first end position, the intermediate position, or the second end position by means of displacement device 24 as a function of the cooking program selected on cooking appliance 2 and of the cooking process being performed in cooking chamber 8, namely as a function of the at least one cooking parameter determined by the at least one sensor. To this end, motor mount drive 38 is controlled by the controller in the desired manner, so that motor mount drive 38 moves holding plate 42 and, thus, the motor 16 attached to holding plate 42 by means of spur gear 48 and gear rack 50 axially to drive shaft 20 from left to right or from right to left in the respective planes of FIGS. 4 and 6*a* through 6*c*. In the process, firstly and analogously to the first exemplary embodiment, fan wheel 14 of fan 12 is moved back and forth between, and positioned in, the first end position, the intermediate position, and the second end position in the desired manner; i.e., as a function of the cooking process, for example. Secondly, and additionally, the inflow of fresh air from the ambient environment is thereby adjusted via annular gap 56. While in the first end position of fan wheel 14, the free cross section of annular gap 56 has the minimum passage area, the free cross section of annular gap 56 increases continuously during the above-mentioned movement of fan wheel 14 from its first end position toward its second end position until the free cross section of annular gap 56 has the maximum passage area when fan wheel 14 is in the second end position. Analogously to the first embodiment, fan wheel 14 is positionable in its intermediate position: i.e., between its first and second end positions. In contrast, it would, of course, also be conceivable for the fan wheel to be positionable in a plurality of intermediate positions. In this connection, the movement of fan wheel 14 may be continuous or in steps.

Due to the inventive design of the cooking appliance and method according to the present exemplary embodiments, namely due to the variable positioning of fan wheel 14 of fan 12 in cooking chamber 8 axially to drive shaft 20, a flow through oven chamber 8 is thus adjustable, thereby allowing a cooking process being performed in cooking chamber 8 of cooking appliance 2 to be influenced in the desired manner. Accordingly, the heat distribution in cooking chamber 8 and, thus, the cooking result of a cooking process being performed in cooking chamber 8 of cooking appliance 2 can be influenced much better in the desired manner. Thus, the cooking process is controllable in the desired manner not only via a rotational speed of fan 12 for circulating the cooking chamber air, but also by the position of fan wheel 14 in cooking chamber 8 axial to drive shaft 20, for example, behind the rear wall 22 placed in cooking chamber 8. In the second exemplary embodiment, moreover, the supply air quantity: i.e., the amount of fresh air drawn in from the ambient environment by fan 12 through annular gap 52, is adjustable and, thus, the heat distribution in cooking chamber 8 is, in addition, controllable substantially independently of the rotational speed of fan 12 as a function of an operating state of cooking appliance 2 and/or a cooking program selected on cooking appliance 2 and/or a cooking process in cooking chamber 8. In this connection, the positioning of fan wheel 12 axially to drive shaft 20 in the aforementioned range between the first end position and the second end position of fan wheel 14 may be effected continuously or in steps. Accordingly, this provides another way of influencing a cooking process and, thus, the cooking result of a cooking process being performed in cooking chamber 8 of cooking appliance 2. In combination with different rotational speeds of fan 12 for circulating the cooking chamber air and/or with a controlled removal of cooking vapors from cooking chamber 8, additional possibilities arise in the first and second exemplary embodiments for varying a flow through oven chamber 8 of cooking appliance 2 while a cooking process is in progress.

However, the invention is not limited to the present exemplary embodiments.

For example, the cooking appliance according to the invention can be freely selected within wide suitable limits. In this regard, see the relevant explanations in the introductory part of the description While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cooking appliance, comprising:

a housing;

a cooking chamber disposed in the housing and bounded by cooking chamber walls of the housing;

a cooking chamber door configured to close a cooking chamber opening of the cooking chamber in a closed position of the cooking chamber door;

at least one heater configured to heat the cooking chamber;

a fan configured to circulate cooking chamber air present in the cooking chamber, a fan wheel of the fan being disposed in the cooking chamber, and a motor of the fan being mounted on the housing outside the cooking chamber, the fan wheel being torque-transmittingly connected to the motor via a drive shaft extending through a drive shaft opening in one of the cooking chamber walls; and a controller configured to control the heater and the fan, wherein the fan wheel is automatically displaceable axially to the drive shaft between a first end position and a second end position of the fan wheel and positionable in the respective end positions by a displacement device of the cooking appliance connected in signal communication with the controller, the displacement and positioning being performed as a function of an operating state of the cooking appliance and/or a cooking program selected on the cooking appliance and/or a cooking process in the cooking chamber, and wherein the displacement device is configured such that the fan wheel is automatically positionable by the displacement device in at least one intermediate position of the fan wheel between the first end position and the second end position as a function of an operating state of the cooking appliance and/or a cooking program selected on the cooking appliance and/or a cooking process in the cooking chamber.

2. The cooking appliance of claim 1, further comprising:

at least one sensor connected in signal communication with the controller and configured to automatically sense at least one cooking parameter of the cooking process.

3. The cooking appliance of claim 2, wherein the at least one sensor comprises a cooking chamber camera configured to observe a food item present in the cooking chamber and/or a humidity sensor configured to determine a cooking chamber humidity prevailing in the cooking chamber and/or a temperature sensor configured to determine a cooking chamber temperature in the cooking chamber and/or a food item temperature of a food item present in the cooking chamber.

4. The cooking appliance of claim 1, wherein the displacement device includes the motor, the motor comprising a shaded-pole motor such that the drive shaft torque-transmittingly connected to a rotor of the shaded-pole motor automatically moves the fan wheel to, and positions the fan wheel in, its first end position or in its second end position by the rotor supported in a stator of the shaded-pole motor, such movement and positioning being performed as a function of the manner in which a plurality of coils of the stator are controlled.

5. The cooking appliance of claim 1, wherein a cone is formed and disposed on the drive shaft and a conical boundary surface of the drive shaft opening, which boundary surface corresponds in configuration to the cone, is formed and disposed on the cooking chamber wall bounding the drive shaft opening such that the cone and the boundary surface form an annular gap for supplying fresh air from an ambient environment into cooking chamber, a free cross section of the annular gap having a pre-defined minimum passage area in the first end position of the fan wheel and a pre-defined maximum passage area in the second end position of the fan wheel.

6. The cooking appliance of claim 5, wherein, when the fan wheel is in the at least one intermediate position, the free cross section of the annular gap has a passage area a size of which is between the minimum passage area and the maximum passage area.

7. The cooking appliance of claim 5, wherein the displacement device includes a motor mount for the motor, which motor mount is movably supported on the housing, and a motor mount drive force-transmittingly connected to the motor mount, the motor mount being displaceable axially to the drive shaft as a function of the motor mount drive being controlled by the controller.

8. The cooking appliance of claim 7, wherein the motor mount includes a holding plate movably supported on the housing by a linear guide device of the cooking appliance for the motor mount, preferably, in that the linear guide device includes a plurality of guide pins and corresponding guide openings, particularly preferably, in that the guide pins are disposed on the housing and the guide openings are disposed or formed on the holding plate.

9. The cooking appliance of claim 8, wherein the linear guide device includes a plurality of guide pins and corresponding guide openings.

10. The cooking appliance of claim 9, wherein the plurality of guide pins are disposed on the housing and the corresponding guide openings are disposed or formed on the holding plate.

11. The cooking appliance of claim 7, wherein the motor mount drive controllable by the controller has a spur gear, and the holding plate has a gear rack which corresponds in configuration to the spur gear and is in engagement therewith.

12. A method for operating the cooking appliance of claim 1, comprising:

automatically displacing the fan wheel to the drive shaft between the first end position and the second end position and positioned the fan wheel in the respective end positions by the displacement device, such displacement and positioning being performed as the function of the operating state of the cooking appliance and/or the cooking program selected on the cooking appliance and/or the cooking process in the cooking chamber.

13. The method of claim 12, wherein the displacement device automatically positions the fan wheel in at least one intermediate position of the fan wheel between the first end position and the second end position as a function of the operating state of the cooking appliance and/or the cooking program selected on the cooking appliance and/or the cooking process in the cooking chamber.

14. The method of claim 12, wherein the cooking appliance has at least one sensor connected in signal communication with the controller and configured to automatically sense at least one cooking parameter of the cooking process.

15. The method of claim 14, wherein the at least one sensor is configured to observe, in a camera-based manner, a food item present in the cooking chamber and/or to determine a cooking chamber humidity prevailing in the cooking chamber and/or to determine a cooking chamber temperature in the cooking chamber and/or a food item temperature of a food item present in the cooking chamber.

16. A cooking appliance, comprising:

a housing;

a cooking chamber disposed in the housing and bounded by cooking chamber walls of the housing;

a cooking chamber door configured to close a cooking chamber opening of the cooking chamber in a closed position of the cooking chamber door;

at least one heater configured to heat the cooking chamber;

a fan configured to circulate cooking chamber air present in the cooking chamber, a fan wheel of the fan being disposed in the cooking chamber, and a motor of the fan being mounted on the housing outside the cooking chamber, the fan wheel being torque-transmittingly connected to the motor via a drive shaft extending through a drive shaft opening in one of the cooking chamber walls; and a controller configured to control the heater and the fan, wherein the fan wheel is automatically displaceable axially to the drive shaft between a first end position and a second end position of the fan wheel and positionable in the respective end positions by a displacement device of the cooking appliance connected in signal communication with the controller, the displacement and positioning being performed as a function of an operating state of the cooking appliance and/or a cooking program selected on the cooking appliance and/or a cooking process in the cooking chamber, and wherein the displacement device includes the motor, the motor comprising a shaded-pole motor such that the drive shaft torque-transmittingly connected to a rotor of the shaded-pole motor automatically moves the fan wheel to, and positions the fan wheel in, its first end position or in its second end position by the rotor supported in a stator of the shaded-pole motor, such movement and positioning being performed as a function of the manner in which a plurality of coils of the stator are controlled.

17. The cooking appliance of claim 16, wherein the plurality of coils comprise a first coil and a second coil separated from the first coil by an electric insulator, the first coil, second coil, and controller being configured such that the first coil and the second coil are electrically conductively interconnectable by the controller in a series electrical circuit and/or in a parallel electrical circuit.

18. The cooking appliance of claim 16, wherein the drive shaft torque-transmittingly automatically moves the fan wheel to/in its first end position, to/in its at least one intermediate position, or to/in its second end position.

19. The cooking appliance of claim 16, wherein the plurality of coils comprise a first coil and a second coil separated from the first coil by an electric insulator, the first coil, second coil, and controller being configured such that the first coil and the second coil are electrically conductively interconnectable by the controller in a series electrical circuit and/or in a parallel electrical circuit.

20. A method for operating a cooking appliance, the cooking appliance comprising: a housing; a cooking chamber disposed in the housing and bounded by cooking chamber walls of the housing; a cooking chamber door configured to close a cooking chamber opening of the cooking chamber in a closed position of the cooking chamber door; at least one heater configured to heat the cooking chamber; a fan configured to circulate cooking chamber air present in the cooking chamber, a fan wheel of the fan being disposed in the cooking chamber, and a motor of the fan being mounted on the housing outside the cooking chamber, the fan wheel being torque-transmittingly connected to the motor via a drive shaft extending through a drive shaft opening in one of the cooking chamber walls; and a controller configured to control the heater and the fan, the method comprising:

automatically displacing the fan wheel to the drive shaft between the first end position and the second end position and positioned the fan wheel in the respective end positions by the displacement device, such displacement and positioning being performed as the function of the operating state of the cooking appliance and/or the cooking program selected on the cooking appliance and/or the cooking process in the cooking chamber, wherein the displacement device automatically positions the fan wheel in at least one intermediate position of the fan wheel between the first end position and the second end position as a function of the operating state of the cooking appliance and/or the cooking program selected on the cooking appliance and/or the cooking process in the cooking chamber.

* * * * *